US005188028A

United States Patent [19]

Reichel

[11] Patent Number: 5,188,028

[45] Date of Patent: Feb. 23, 1993

[54] PRINTING MACHINE DAMAGE CONTROL SYSTEM, AND DAMAGE CONTROL METHOD

[75] Inventor: Klaus T. Reichel, Augsburg, Fed. Rep. of Germany

[73] Assignee: Man Roland Druckmaschinen Ag, Offenbach am Main, Fed. Rep. of Germany

[21] Appl. No.: 778,392

[22] Filed: Oct. 16, 1991

[30] Foreign Application Priority Data

Dec. 7, 1990 [DE] Fed. Rep. of Germany ..... 4039108

[51] Int. Cl.[5] ..... B41F 5/04; B41F 13/22

[52] U.S. Cl. ..... 101/228; 101/484; 101/487

[58] Field of Search ..... 101/228, 219, 181, 178, 101/180, 182, 484, 487; 242/75.3, 75.43, 75.44, 75.51, 58.1, 58.6; 226/24, 42, 44, 45, 8; 73/862.48, 862.65, 862.45, 862.46; 318/6

[56] References Cited

U.S. PATENT DOCUMENTS

| | | | |
|---|---|---|---|
| 3,031,152 | 4/1962 | Cohen et al. | 242/75.51 |
| 3,936,008 | 2/1976 | Crum | 242/75.44 |
| 4,508,033 | 4/1985 | Fischer | 101/228 X |
| 4,549,485 | 10/1985 | Nawrath | 101/228 |
| 4,549,701 | 10/1985 | Lucas | 242/75.3 |
| 4,709,872 | 12/1987 | Hammer et al. | 242/75.43 |
| 4,896,808 | 1/1990 | Bolza-Schünemann et al. | 242/75.51 |
| 4,949,910 | 8/1990 | Kleitz et al. | 242/58.1 |
| 4,958,111 | 9/1990 | Gago | 226/24 |
| 5,024,156 | 6/1991 | Hank et al. | 226/45 X |
| 5,036,765 | 8/1991 | Keilhau | 101/228 |

FOREIGN PATENT DOCUMENTS

| | | |
|---|---|---|
| 0349821 | 1/1990 | European Pat. Off. . |
| 2156505 | 2/1973 | Fed. Rep. of Germany . |
| 3431686 | 4/1986 | Fed. Rep. of Germany . |
| 3437455 | 4/1986 | Fed. Rep. of Germany . |
| 1589601 | 5/1970 | France . |
| 2103810 | 2/1983 | United Kingdom . |

*Primary Examiner*—J. Reed Fisher

*Attorney, Agent, or Firm*—Frishauf, Holtz, Goodman & Woodward

[57] ABSTRACT

To permit triggering a torn web capturing roller system (9, 10, 11) or a web deflection unit (28) for rapid capture of a torn or damaged web (7) in a printing machine system having a printing station (2) and thus prevent wrap-around of torn webs about elements of the printing station, the web is guided about a cooling roller or cylinder (14) downstream of a web dryer and strain between and cooling roller and the side wall of the printing machine is measured. This strain is measured for example, by a piezoelectric tranducer or a strain gauge (23) coupled to a bearing (21) in a side wall (19) in the printing machine. The signal from the transducer (18), for example the strain gauge (23), is evaluated in a computer and control unit (26), for example with respect to a reference. The reference can be modified, if desired, by entering in the computer or control unit data representative of acceleration and deceleration of the machine, per square weight of the web, weight of the cooling roller or cylinder (14) and the like.

20 Claims, 2 Drawing Sheets

PRINTING MACHINE DAMAGE CONTROL SYSTEM, AND DAMAGE CONTROL METHOD

Reference to related patent, the disclosure of which is hereby incorporated by reference, assigned to the assignee of the present application:

U.S. Pat. No. 5,036,765, Keilhau.

Reference to related publications:

German Patent 21 56 505.

U.S. Pat. No. 4,549,585, Nawrath, to which German Patent Disclosure Document DE-OS 32 15 473 corresponds.

German Patent Disclosure Document DE-OS 35 00 719.

FIELD OF THE INVENTION

The present invention relates to a method and system to control damage to a printing machine of the web type, in case the web passing through the printing machine should tear, and more particularly to prevent damage to machine cylinders if the web should wrap itself several times about a cylinder or roller thereof. The system is particularly applicable to rotary web-type offset printing machines having a dryer and a cooler.

BACKGROUND

Various types of apparatus are known to control damage to printing machine in case a web passing through the machine should tear, see for example German Patent 21 56 505. Tear of the web can be sensed, as well known, in various ways, for example by an optical sensor. Apparatus as known have the disadvantage that the rollers or cylinders which are used to roll on a torn web are activated only with delay when a web tear has been sensed by a web tearing arrangement. As described in the referenced Patent 21 56 505, optical electrical control systems are used to determine tearing of a web, and generating a "torn web" signal when a web tear is sensed. As soon as a web tear is sensed, the signal causes deflection of the torn web, and the signal causes activation of capturing rollers engaged against each other to wind up the torn web. Damage to the printing system is thereby prevented since the torn web will not wrap itself about rollers or cylinders of the printing machine. The referenced U.S. Keilhau Patent 5,036,765, the disclosure of which is hereby incorporated by reference, as well as the German Patent Disclosure Documents 32 15 473 and 35 00 719, show the history of efforts to increase the response speed of paper capturing apparatus. This history extends over many decades. The ever increasing printing speeds, and hence web passage speeds of web-type rotary printing machines, and especially offset rotary printing machines, cause increasing problems with respect to delay of response of a damage control cylinder or roller pair with respect to actual sensing of a web tear. The components used in the damage control systems have inertia and it is hardly possible to decrease the response speed below a period of about 30 milliseconds.

THE INVENTION

It is an object to provide a system and method to prevent damage to printing machines upon occurrence of a web tear or incipient occurrence of a complete web tear, in which the response speed of a web deflection element or, respectively, a capturing cylinder or roller arrangement, is substantially increased.

Briefly, a roller, typically a cooling roller, of a cooling unit which is in a position in a printing system downstream of the usual occurrence of web tears is coupled to a web tension sensing arrangement, for example a strain gauge coupled to its bearings, which provides output signals connected to a computer and control apparatus responsive to determine whether the web tension signal is below a predetermined reference value, and if so, provides a "torn web" signal. This "torn web" signal is transmitted to a capturing roller system for, first, enabling capturing of the torn web and then shutting down the printing machine.

The system of the invention has the capability of rapidly evaluating the web tension signals as the web is wrapped around that cooling roller. When the web tension drops below a predetermined level, and especially when the web tension drops to zero, the computer and control apparatus can provide a signal to a capturing roller arrangement, of any suitable and well known construction, to wrap up the web about the capturing roller or capturing roller system or pair.

The arrangement has the advantage that decrease in web tension below a predetermined level will be determined before the web is actually completely torn through, that is, before the web will deflect after it has been torn. This permits capturing roller pairs or web deflection arrangements to be triggered into roll-up or wrap-up or deflection operation much earlier than in known systems, so that the reliability of the overall system is enhanced and printing systems and printing stations are protected against damage due to wrap-up of torn webs.

DRAWINGS

FIG. 1 is a highly schematic representation of a web rotary printing machine and having the system in accordance with the present invention; and FIG. 2 is a fragmentary detailed view of the system and specifically showing a cooling roller used in the system and carrying out the method of FIG. 1.

DETAILED DESCRIPTION

Figure 1:
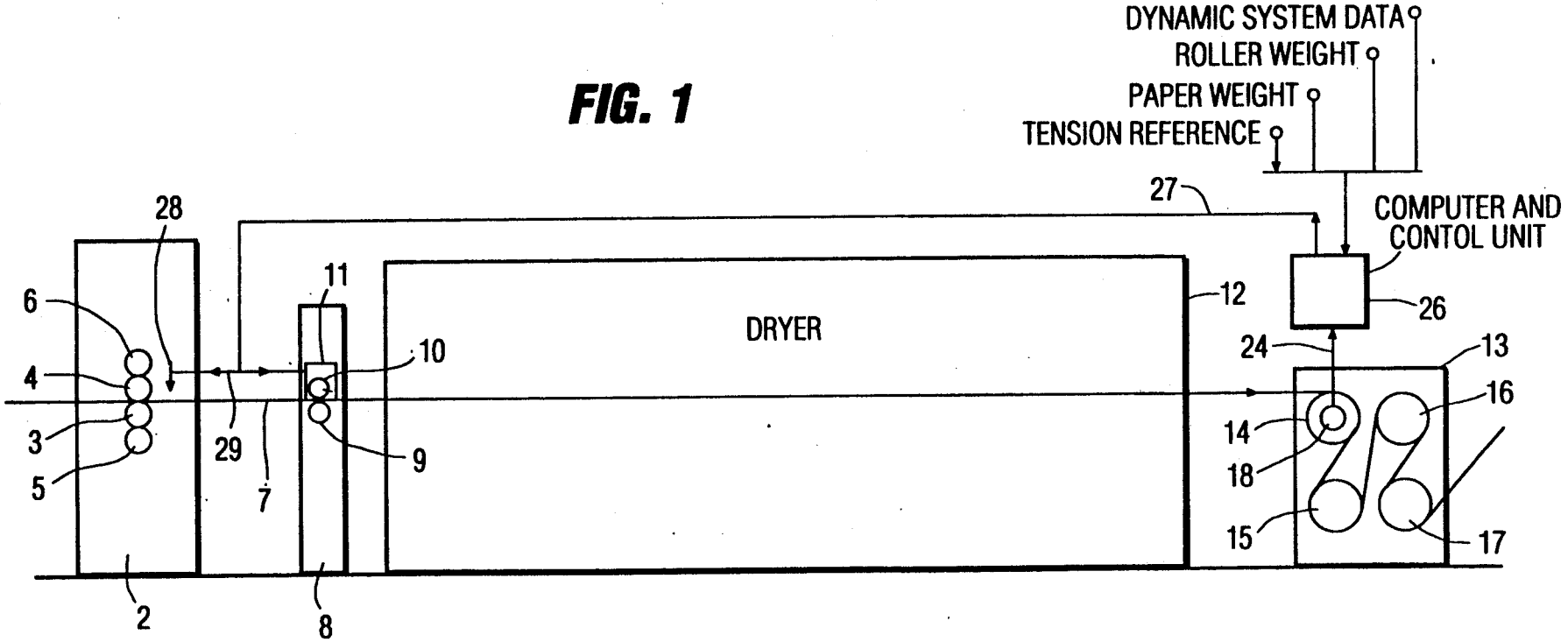
Figure 2:
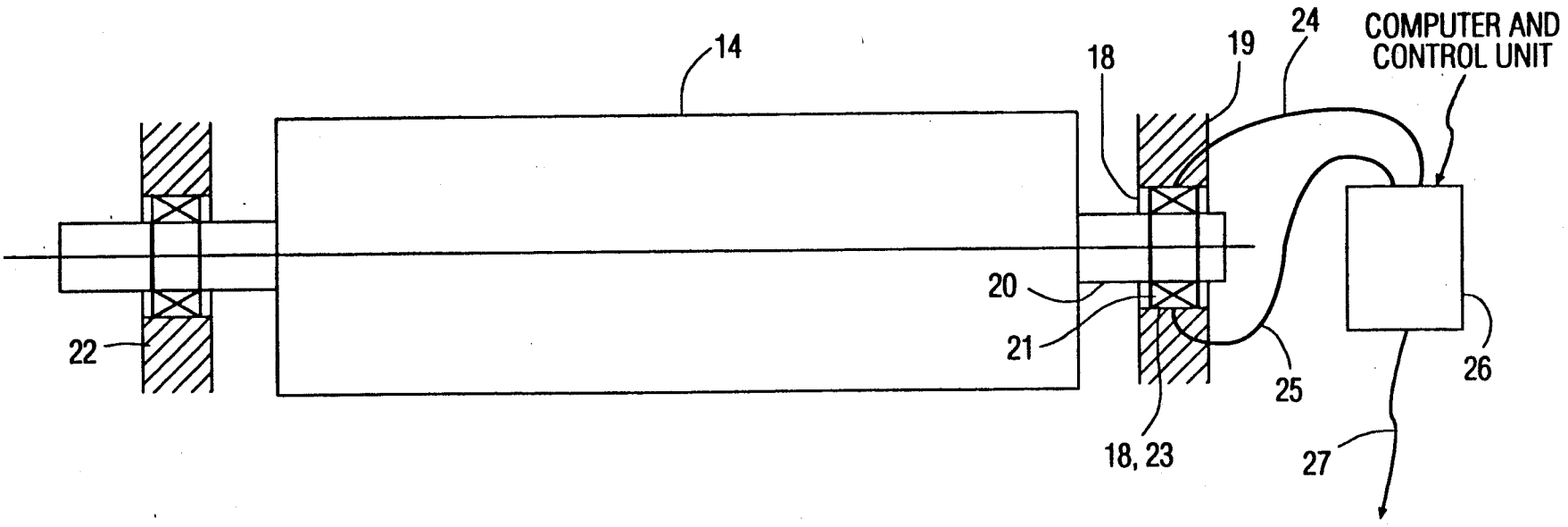

Rotary printing machines, for example offset web-type rotary printing machines as shown in FIG. 1, may have a plurality of printing stations or printing systems of which only one is shown, highly schematatically, in FIG. 1.

The station 2 receives a web 7 and, as is customary, has two blanket cylinders 3, 4, and plate cylinders 5, 6 in engagement with the blanket cylinders, to form two printing couples for perfecting printing on the web 7 passing between the blanket cylinders 3, 4. After the blanket cylinders leave the last printing station, in this case station 2, the web 7 is passed between a paper capturing system 8. The capturing system 8 may, for example, include two spaced capturing rollers 9, 10. Under ordinary operating conditions, the web passes between the rollers 9, 10, without touching either one of the rollers. A triggering system 11 is provided which, when activated, engages the capturing rollers against each other so that a torn web can be wrapped about one of the capturing rollers, so that the torn web will not be drawn into the last printing station 2 where substantial damage to the cylinders 3–6 might occur. Such web capturing systems are known and the referenced U.S. Pat. No. 5,036,765, Keilhau, describes a suitable system.

The web, after passing between the normally spaced capturing rollers 9, 10, then passes through a dryer 12.

The dryer 12, which normally includes heating elements, is then followed by a cooling unit or cooling station 13, having cooling rollers 14, 15, 16, 17.

In accordance with a feature of the present invention, one of the cooling rollers, and preferably the first cooling roller 14 following the dryer 12, has a transducer 18 coupled thereto which senses the tension of the web which passes about the cooling roller 14. The transducer 18 may be a strain gauge or a piezoelectric element. Transducer 18 is located in a side wall, preferably in or on a stub shaft 20 of the first cooling roller 14, or on the bearing 21 in which the stub shaft 20 is located, to retain the shaft within the side wall 19 of the printing machine. The other side of the roller 14 is located, as well known, in another side wall 22 of the printing machine. The web 7, preferably, is wrapped around the cooling roller 14 by a loop including at least 60°, and preferably more—see FIG. 1.

The transducer 18, for example a strain gauge 23 which is well known, is coupled by connecting lines 24, 25 to a control unit 26. The computer and control unit 26 which can be a combined computer and control unit can be a process computer which senses signals derived from the transducer 23 and evaluates these electrical signals. The computer 26 is coupled to suitable input-/output units with which comparison or reference or desired values can be entered, for comparison with the actual values derived from the transducer 18. Additionally, the computer 26 may receive input values relative to the printing machine, such as data relevant to the operation, including, for example, the weight of the cooling roller 14, the weight of the web 7, and dynamic parameters specific to the printing machine, such as data relating to starting, start-up and acceleration, deceleration, stopping, stopping under emergency conditions and the like. By suitable programming of the control unit 26, machine-specific data can be interrelated, and considered when signals from the transducer 23 are derived which are beyond or out of the range of normal tension of the web 7.

Upon occurrence of a tear in the web 7—which need not be a tear all the way across, but only a partial tear, forces acting on the bearings 21 in which the roller 14 is retained in side walls 19, 22 will change. This results in a change in the signals derived from the transducer 18 and, hence, the computer and control unit 26 can determine long before the web 7 is completely torn through that the web is damaged and subjected to, for example, a partial defect. The control unit 26 can thus provide, already at that time, a trigger signal to the triggering device 11 of the capturing unit 8 or may, alternatively, or in addition thereto, provide a triggering signal over line 29 to a web deflection arrangement 28 which deflects the web from its normal path and prevents wrap around of torn web about the cylinders of the printing couples 3, 5 or 4, 6, respectively. The control, derived from the control unit 26 and connected via line 27 to the triggering device 11, or line 27 and 29 to the deflection device 28, respectively, can be generated when the web tension drops below a predetermined value, indicative of an incipient tear and of course also when the tension value drops to zero, which would be indicative of a complete tear-through.

The system has the advantage that the response time of a capturing roller pair 9, 10 or a web deflection arrangement 28, all of which are known as such and can be of standard construction, can be substantially improved with respect to the actual occurrance of a tear of the web.

Various changes and modifications may be made within the scope of the inventive concept.

I claim:

1. Printing machine damage control system for a web-type printing machine, wherein said printing machine includes, sequentially in the running direction of the web, a printing station (2), a dryer unit (12) and a cooling unit (13), and said cooling unit has a cooling roller or cylinder (14), the web being at least partly looped about the cooling roller or cylinder, and means (9, 10, 11; 28) located upstream of the printing station for separating a torn web from the printing station (2), said system comprising, in accordance with the invention, web tension sensing means (18, 23) operatively coupled to the cooling roller or cylinder (14) of the cooling unit (13) and generating a web tension signal representative of the tension of the web as it passes around the cooling roller;

control means (26) responsive to the web tension signal and determining whether the web tension signal is below a predetermined web tension level and hence indicative of a web tear, or damage, or incipient web tear; and connection means (27, 29) connected to and controlled by said control means to control said torn web separating means to separate the web from said printing station (2) upon determination by said control means that the web tension signal is below said predetermined level.

2. The system of claim 1, wherein said web tension sensing means comprises electromechanical means (18, 23);

bearing means (21) are provided for retaining said cooling roller or cylinder (14) within a side wall (19) of the printing machine; and wherein said web tension sensing means (18, 23) are operatively coupled to the bearing means (21).

3. The system of claim 2, wherein said web tension sensing means comprises a strain gauge (23) operatively coupled to the bearing means (21) and the side wall (19) of the printing machine.

4. The system of claim 1, wherein said cooling unit (13) includes a plurality of cooling rollers or cylinders;

and wherein the web tension means (18, 23) are coupled to the first one of the cooling rollers or cylinders engaged by said web (7) as the web passes through the cooling unit.

5. The system of claim 4, wherein the web is looped about said first one cooling roller or cylinder (14) by a wrap angle of at least 60°.

6. The system of claim 1, wherein said control means (26) comprises computer apparatus receiving input data representative of desired at least one of: or reference tension of the web (7), weight of said cooling roller or cylinder (14), weight of said web (7) per unit area, and dynamic system data characteristic of acceleration and deceleration of the printing machine.

7. The system of claim 1, wherein said predetermined web tension level is a tension level close to zero or null.

8. The system of claim 6, wherein said web tension sensing means comprises electromechanical means (18, 23);

bearing means (21) are provided for retaining said cooling roller or cylinder (14) within a side wall (19) of the printing machine; and wherein said web tension sensing means (18, 23) are operatively coupled to the bearing means (21).

9. The system of claim 1, wherein said predetermined web tension level is representative of the tension of a damaged web as it is looped about the cooling roller or cylinder and before the web is completely torn through.

10. The system of claim 1, wherein said control means (26) comprises a control apparatus receiving input data representative of said predetermined web tension level.

11. The system of claim 10, wherein said predetermined web tension level is representative of the tension of a damaged web as it is looped about the cooling roller or cylinder and before the web is completely torn through.

12. A method to prevent damage to a printing machine which has a printing station (2), a dryer unit (12) and cooling unit (13), and in which the cooling unit (13) has a cooling roller or cylinder (14), and in which, further, means (9, 10, 11; 28) are provided for separating a torn web from the printing station (2) upon occurrence of a tear or damage to a web (7) passing through the printing machine, comprising the steps of guiding the web (7) about said cooling roller or cylinder (14) by a predetermined wrap angle;

sensing web tension as the web passes about said cooling roller or cylinder by web tension sensing means operatively coupled to the cooling roller or cylinder of the cooling unit;

generating a signal representative of sensed web tension of the web as it passes around the cooling roller or cylinder; and determining if said signal has a level indicative of a tear or incipient tear of said web as evidenced by a drop in sensed tension by control means responsive to the web tension signal; controlling said torn web separating means to separate the web from said printing station upon determination by said control means that the web tension signal is below a predetermined level.

13. The method of claim 12, wherein said step of sensing tension of the web comprises sensing strain between a bearing (21) retaining said cooling roller or cylinder (14) in a side wall (19) of the printing machine.

14. The method of claim 13, wherein said step of sensing the strain comprises evaluating the signal from a strain gauge (23).

15. The method of claim 13, wherein said step of evaluating the signal comprises evaluating the strain signal from a piezoelectric transducer.

16. The method of claim 12, wherein said step of evaluating the tension of the web (7) in the machine comprises looping said web about the cooling roller or cylinder (14) by a wrap angle of at least 60°.

17. The method of claim 12, including the step of controlling said separating means as a function of the determination of the level of said signal.

18. The method of claim 17, wherein said control step includes comparing said signal with a value which is dependent on tension of the web (7) and on at least one of: weight of the cooling roller (14); weight of the web (7); dynamic characteristics of acceleration and deceleration of the printing machine.

19. The method of claim 17, wherein said control step comprises comparing said signal representative of sensed web tension with a value representative of tension of the web before the web is completely torn through.

20. The method of claim 19, wherein said step of sensing tension of the web comprises sensing strain between a bearing (21) retaining said cooling roller or cylinder (14) in a side wall (19) of the printing machine.

* * * * *